US008171704B2

(12) United States Patent
Boriani et al.

(10) Patent No.: US 8,171,704 B2
(45) Date of Patent: May 8, 2012

(54) METHOD AND DEVICE FOR FINISHING PACKETS HAVING RESPECTIVE OVERWRAPPINGS OF HEAT-SHRINK MATERIAL

(75) Inventors: Silvano Boriani, Bologna (IT); Stefano Negrini, Calderara di Reno (IT)

(73) Assignee: G. D. Societa' per Azioni, Bologna (IT)

( * ) Notice: Subject to any disclaimer, the term of this patent is extended or adjusted under 35 U.S.C. 154(b) by 703 days.

(21) Appl. No.: 11/887,042

(22) PCT Filed: Mar. 23, 2006

(86) PCT No.: PCT/EP2006/060986

§ 371 (c)(1),
(2), (4) Date: Dec. 4, 2008

(87) PCT Pub. No.: WO2006/100287

PCT Pub. Date: Sep. 28, 2006

(65) Prior Publication Data

US 2009/0211203 A1 Aug. 27, 2009

(30) Foreign Application Priority Data

Mar. 24, 2005 (IT) ..... BO2005A0188

(51) Int. Cl.
*B65B 19/22* (2006.01)

(52) U.S. Cl. ..... 53/442; 53/477; 53/557

(58) Field of Classification Search ..... 53/441, 53/442, 477, 557, 556

See application file for complete search history.

(56) References Cited

U.S. PATENT DOCUMENTS

| | | | | |
|---|---|---|---|---|
| 3,166,462 | A * | 1/1965 | Schoder | 156/499 |
| 3,555,772 | A * | 1/1971 | Kammer | 53/526 |
| 3,830,036 | A | 8/1974 | Harkness et al. | |
| 4,330,977 | A * | 5/1982 | Focke | 53/371.7 |
| 4,843,800 | A * | 7/1989 | Focke | 53/477 |
| 5,058,361 | A | 10/1991 | Schmacher | |
| 5,299,406 | A * | 4/1994 | Laury | 53/397 |
| 5,784,864 | A * | 7/1998 | Laury | 53/557 |
| 6,068,106 | A * | 5/2000 | Brizzi et al. | 198/448 |
| 6,511,405 | B1 | 1/2003 | Focke et al. | |
| 7,131,247 | B2 * | 11/2006 | Boriani et al. | 53/442 |
| 7,200,978 | B1 * | 4/2007 | Focke et al. | 53/441 |
| 7,337,597 | B2 * | 3/2008 | Assirelli et al. | 53/540 |
| 7,389,631 | B2 * | 6/2008 | Assirelli et al. | 53/557 |
| 2004/0151481 | A1 | 8/2004 | Cassoli et al. | |

(Continued)

FOREIGN PATENT DOCUMENTS

| | | |
|---|---|---|
| DE | 38 24924 | 1/1990 |

(Continued)

OTHER PUBLICATIONS

Non-English Action from the Japanese Patent Office in respect of Application No. JP 502419/2008 and an English-language version.

*Primary Examiner* — Hemant M Desai
(74) *Attorney, Agent, or Firm* — Ladas & Parry LLP

(57) ABSTRACT

A method and device for finishing packets having respective overwrappings of heat-shrink material, whereby the overwrappings are sealed about the respective packets and then heated to shrink and adapt to the configuration of the packets; after being heated, the overwrappings are cooled to set and so reduce the risk of damage to the overwrappings at subsequent processing stages.

23 Claims, 2 Drawing Sheets

U.S. PATENT DOCUMENTS

2008/0250757 A1* 10/2008 Blome ..... 53/371.8

FOREIGN PATENT DOCUMENTS

| | | | |
|---|---|---|---|
| EP | 1 103 465 | | 5/2001 |
| GB | 1 234 731 | | 6/1971 |
| JP | 5-262330 | A | 10/1993 |
| JP | 2001-122223 | A | 5/2001 |
| JP | 2006-124032 | A | 5/2006 |

* cited by examiner

METHOD AND DEVICE FOR FINISHING PACKETS HAVING RESPECTIVE OVERWRAPPINGS OF HEAT-SHRINK MATERIAL

This application is 35 U.S.C. 371 application of PCT/EP2006/060986 filed on Mar. 23, 2006, which claims the benefit of Italian Patent Application No. BO2005A 000188 filed on Mar. 24, 2005.

TECHNICAL FIELD

The present invention relates to a method and device for finishing packets having respective overwrappings of heat-shrink material.

In particular, the present invention relates to a device for finishing packets having respective overwrappings of heat-shrink material, the device comprising feed means for feeding at least a first and at least a second packet, each of which has a respective lateral surface, along a first and second feed path, respectively, to a work station through a sealing station and a heat-shrink station; a sealing unit located at the sealing station to seal the overwrappings about respective packets; a heat-shrink unit located at the heat-shrink station to heat the overwrappings, so that the overwrappings shrink and adapt to the configuration of the packets; in the area of the work station, in use, the first and second packet are brought together so that the lateral surfaces of the first and second packet are brought into contact with each other; the heat-shrink unit comprising at least one heating member for shrinking the overwrapping of the first packet by heating at least the lateral surface of the first packet.

BACKGROUND ART

The present invention may be used to advantage in the packing of cigarettes, to which the following description refers purely by way of example.

U.S. Pat. No. 6,511,405 discloses that packs, once an outer wrapper has been provided and sealed, are conveyed through a shrinking station and subjected to the action of heat in the region of the large-surface-area pack sides, in particular in the region of upwardly directed front sides. For this purpose, heating plates are positioned in the region of the shrinking station and transmit heat to the upwardly directed surfaces of the packs.

Though the shrinkage of the overwrappings normally provides for good aesthetic results, the packets brought together after the shrinkage tend to stick to each other. This leads to further processing difficulties (the packets are to be separated) and to an increased risk of damaging the overwrappings.

DISCLOSURE OF INVENTION

It is an object of the present invention to provide a method and device for finishing packets having respective overwrappings of heat-shrink material, designed to at least partly eliminate the aforementioned drawbacks, and which at the same time are cheap and easy to implement.

According to the present invention, there is provided a device for finishing packets, as claimed in Claim 1 or in any one of the following Claims depending directly or indirectly on Claim 1.

According to the present invention, there is also provided a method of finishing packets, as claimed in Claim 18 or in any one of the following Claims depending directly or indirectly on Claim 18.

BRIEF DESCRIPTION OF THE DRAWINGS

A number of non-limiting embodiments of the present invention will be described by way of example with reference to the accompanying drawings, in which.

BEST MODE FOR CARRYING OUT THE INVENTION

Figure 1:
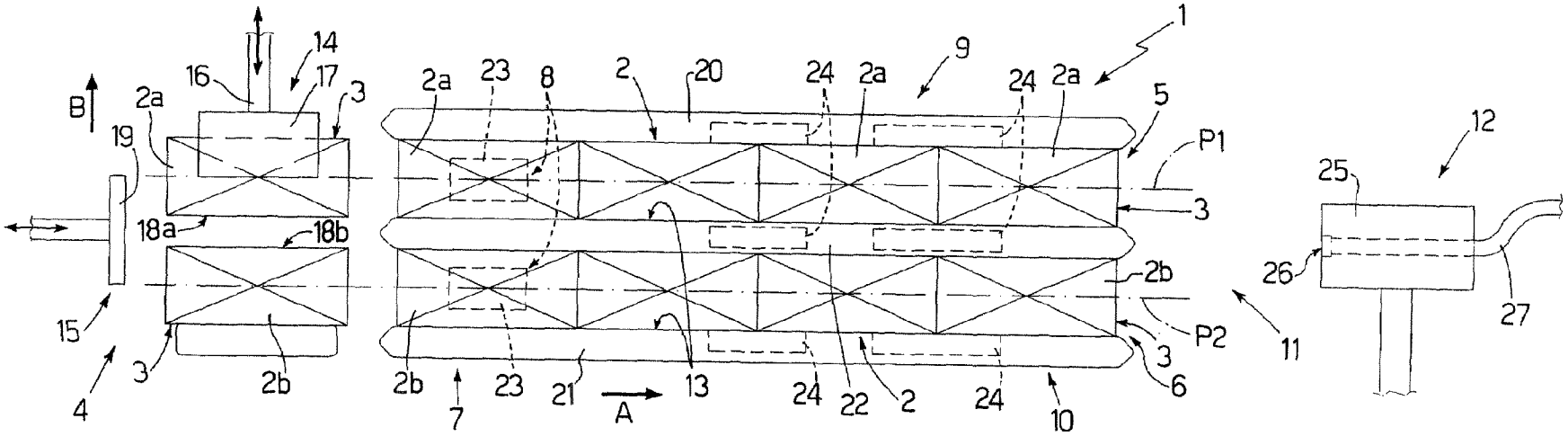
FIG. 1 shows a schematic side view, with parts removed for clarity, of a device in accordance with the present invention.

Number 1 in FIG. 1 indicates as a whole a device for finishing rigid, hinged-lid packets 2 of cigarettes (not shown) having respective overwrappings 3 of heat-shrink material, e.g. polypropylene.

Device 1 comprises a feed unit 4 for feeding two separate rows 5, 6 of respective packets 2*a*, 2*b* along respective first and second feed paths P1, P2 through a sealing station 7, where a sealing unit 8 seals overwrappings 3; through a heat-shrink station 9, where a heat-shrink unit 10 heat-shrinks overwrappings 3 to adapt overwrappings 3 to the configuration of respective packets 2; and through a work station 11, where a cooling unit 12 cools overwrappings 3.

Feed unit 4 comprises two superimposed, substantially parallel feed channels 13; a spacer assembly 14 for separating packets 2*a* and 2*b* immediately upstream from channels 13; and a transfer assembly 15 for feeding the separated packets 2*a* and 2*b* in a substantially horizontal travelling direction A along channels 13.

Spacer assembly 14 comprises a gripping head 16, and an actuator (not shown) for moving gripping head 16 in a substantially vertical direction B; and gripping head 16 comprises jaws 17 (only one shown in FIG. 1) for gripping packets 2*a*. In alternative embodiments not shown, gripping head 16 comprises suction devices instead of jaws 17.

Packets 2*a* have respective major lateral surfaces 18*a*, which, when packets 2*a* and 2*b* are inside channels 13, face downwards and are substantially parallel to travelling direction A and to upward-facing major lateral surfaces 18*b* of packets 2*b*. At work station 11, each packet 2*a* is superposed on a respective packet 2*b*, so that lateral surfaces 18*a* and 18*b* are brought into contact.

Transfer assembly 15 comprises a pusher 19, and an actuator (not shown) for moving the pusher in travelling direction A. Channels 13 partly define feed paths P1 and P2, are bounded by a top slide member 20 and a bottom slide member 21, and are separated by a partition member 22.

Sealing unit 8 comprises a number of sealing heads 23 (shown by dash lines in FIG. 1), which move back and forth crosswise to travelling direction A to correctly seal overwrappings 3.

Heat-shrink unit 10 comprises a number of hot plates 24 (shown by dash lines in FIG. 1) located at slide members 20 and 21 and partition member 22. More specifically, hot plates 24 at partition member 22 are interposed between feed paths P1 and P2 to heat overwrappings 3 of both packets 2*a* and 2*b*.

Cooling unit 12 comprises a cooling head 25 located at the output of channels 13 and alongside feed paths P1 and P2.

Cooling head 25 comprises an outlet nozzle 26 connected to a compressed-air source (not shown) by a conduit 27, and which emits an air jet, in a direction parallel to and opposite travelling direction A, onto partition member 22 and lateral surfaces 18*a*, 18*b*, to cool lateral surfaces 18*a*, 18*b* before lateral surfaces 18*a*, 18*b* are brought into contact with one another.

By so doing, overwrappings 3 set faster and are therefore less subject to deformation at the follow-up processing stages.

More specifically, with reference to device 1, cooling overwrappings 3 after they are heat-shrunk prevents even only partial bonding of lateral surfaces 18*a* and 18*b*. In this connection, it is important to point out that even only partial bonding of overwrappings 3 of superimposed packets 2*a* and 2*b* at work station 11 may result in damage to overwrappings 3 when packets 2*a* are separated from corresponding packets 2*b*.

Moreover, the air jet from nozzle 26 is directed onto partition member 22, so that, in the event of a breakdown of device 1 resulting in packets 2 remaining inside channels 13 for a relatively prolonged period of time, heating of packets 2 by hot plates 24 is reduced fairly quickly, so there is relatively little danger of damage caused by overheating in the event of a machine stoppage.

In a further embodiment not shown, cooling unit 12 comprises movable cooling plates, which provide for cooling by coming into contact with packets 2*a* and 2*b*. The air-jet solution, however, is more advantageous, by comprising a relatively straightforward device and enabling relatively easy, effective cooling of hot plates 24.

Figure 2:
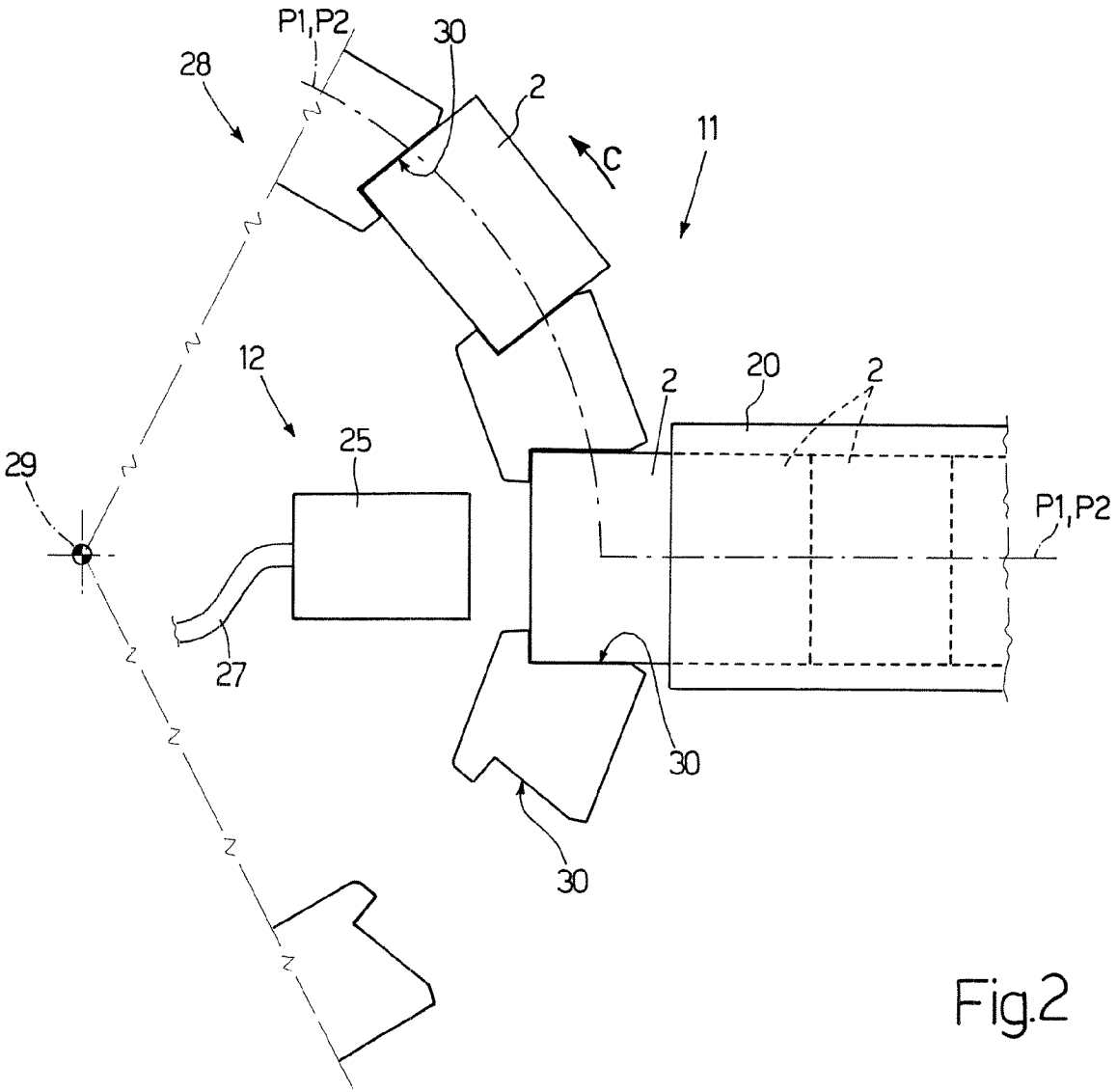
FIG. 2 shows a schematic plan view, with parts removed for clarity, of the FIG. 1 device.

With reference to FIG. 2, device 1 also comprises a conveyor wheel 28 mounted to rotate in steps about a vertical axis 29, and having a number of peripheral pockets 30 equally spaced about axis 29 and for receiving respective pairs of superimposed packets 2*a*, 2*b*.

Conveyor wheel 28 rotates anticlockwise to feed pairs of packets 2*a*, 2*b* successively along feed paths P1 and P2 in a substantially horizontal direction C crosswise to travelling direction A.

Operation of device 1 will now be described relative to one pair of superimposed packets 2*a*, 2*b*, and as of the instant in which the two packets are located immediately upstream from channels 13.

In actual use, once separated vertically in direction B by spacer assembly 14, packets 2*a*, 2*b* are fed along channels 13 by pusher 19. Along channels 13, lateral surfaces 18*a*, 18*b* of packets 21, 2*b* are maintained substantially parallel to travelling direction A.

When packets 2*a*, 2*b* reach sealing station 7, sealing heads 23 are moved to seal the minor lateral walls of the folded overwrappings 3.

At this point, packets 2*a*, 2*b* are fed along to heat-shrink station 9, where the heat from hot plates 24 shrinks overwrappings 3.

Once overwrappings 3 have been heated sufficiently, packets 2*a*, 2*b* are fed along, in travelling direction A, to work station 11, where the air jet from nozzle 26 cools lateral surfaces 18*a*, 18*b*. At this point, conveyor wheel 28 rotates about axis 29 to feed packets 2*a*, 2*b* further along feed paths P1 and P2, and packet 2*a* is superimposed on packet 2*b* so that lateral surfaces 18*a* and 18*b* are brought into contact with each other.

Figure 3:
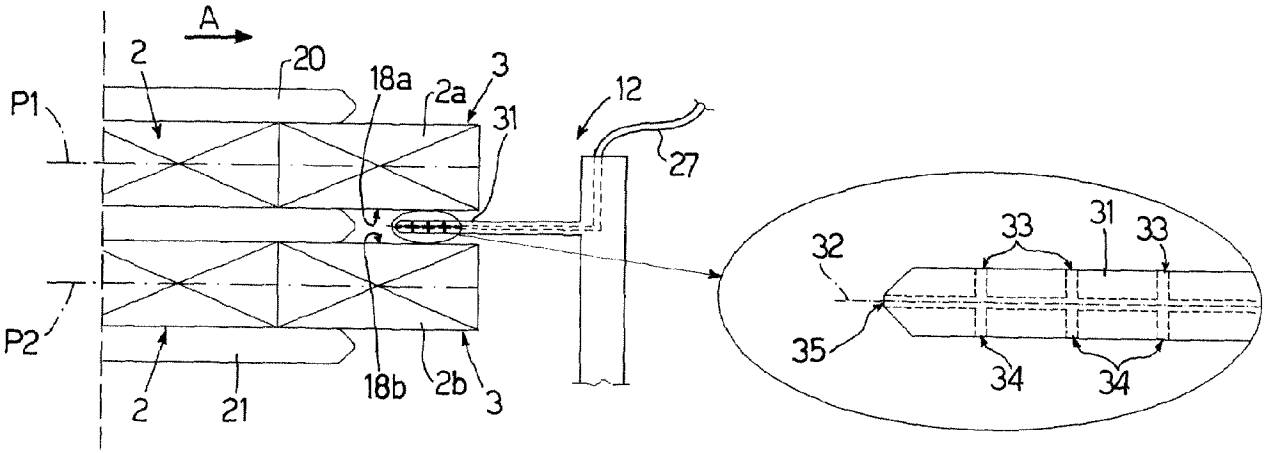
FIG. 3 shows a schematic side view of a further embodiment of a detail of the FIGS. 1 and 2 device.

FIG. 3 shows a further embodiment of cooling unit 12, which, in this case, comprises a substantially cylindrical cooling head 31. Cooling head 31 has an axis 32 substantially parallel to travelling direction A, and is interposed between first and second feed path P1 and P2 at work station 11.

The cooling head 31 comprises a number of—in the example shown, six—outlet nozzles 33 and 34 oriented crosswise to travelling direction A to direct respective air jets onto lateral surfaces 18*a* and 18*b*. More specifically, nozzles 33 (three in number in the example shown) direct respective air jets onto lateral surfaces 18*a* in a direction crosswise to lateral surfaces 18*a*; and nozzles 34 (three in number in the example shown) direct respective air jets onto lateral surfaces 18*b* in a direction crosswise to lateral surfaces 18*b*.

The cooling head also comprises an outlet nozzle 35 oriented parallel to travelling direction A to emit an air jet in the opposite direction to travelling direction A.

Nozzles 33, 34, 35 are connected by conduit 27 to a compressed-air source (not shown).

Though the above description and accompanying drawings refer to finishing rigid, hinged-lid packets of cigarettes, the teachings of the present invention obviously also apply to finishing packets of cigarettes of any type, e.g. "soft" packets, rounded- or bevelled-edged, hinged-lid packets, as well as to finishing packets of other than cigarettes, e.g. packets of food products, confectionary, or toiletries.

The invention claimed is:

1. A device for finishing packets having respective over-wrappings of heat-shrink material, the device comprising:

feed means for feeding at least a first and at least a second packet along a first and second parallel feed paths respectively to a work station through a sealing station and a heat-shrink station, each of the at least first and at least second packet has a respective lateral surface, said lateral surfaces of the at least first packet and at least second packet are superimposed along the first and second parallel feed paths;

a sealing unit located at the sealing station to seal the over-wrappings about respective packets;

a heat-shrink unit located at the heat-shrink station to heat the over-wrappings so that the over-wrappings shrink and adapt to the configuration of the packets, the heat-shrink unit comprising at least one heating member interposed between the first and second feed paths; and means for cooling the superimposed lateral surfaces of the first and second packets before said lateral surfaces of the first and second packet are brought into contact with each other, the means for cooling is located downstream from the heat-shrink station.

2. A device as claimed in claim 1, and comprising at least two feed channels for respectively directing the first and the second packet, along the first and the second feed path, respectively.

3. A device as claimed in claim 2, wherein the first and second feed path are substantially parallel and substantially superimposed; the feed channels maintaining the lateral surfaces of the first and second packet substantially parallel and facing each other; and the first and second packet being superimposed, in use, at the work station, so that the lateral surfaces of the first and second packet are brought into contact with each other.

4. A device as claimed in claim 2, wherein the cooling unit is located at the work station, at the end of the two feed channels.

5. A device as claimed in claim 1, wherein the cooling unit comprises at least one outlet nozzle to emit at least one air jet onto the packets.

6. A device as claimed in claim 5, wherein the outlet nozzle is oriented substantially parallel to the travelling direction (A).

7. A device as claimed in claim 5, wherein the outlet nozzle is oriented crosswise to the travelling direction (A).

8. A device as claimed in claim 1, wherein the cooling unit comprises at least one outlet nozzle to emit at least one air jet onto the lateral surface of the first and/or second packet.

9. A device as claimed in claim 1, wherein the cooling unit comprises at least one outlet nozzle to emit at least one air jet onto the heating member.

10. A device as claimed in claim 1, wherein the cooling unit comprises at least two outlet nozzles, of which one is oriented parallel to the travelling direction (A), and one is oriented crosswise to the lateral surfaces of the first and second packet.

11. A device as claimed in claim 1, wherein the cooling unit comprises at least a first and a second outlet nozzle to emit at least a first and a second air jet, respectively; the first air jet being directed onto the packets, and the second air jet being directed onto the heating member.

12. A device as claimed in claim 1, wherein the cooling unit comprises a cooling head interposed between the first and second feed path, so that the first and second packet travel, in use, on opposite sides of the cooling head.

13. A device as claimed in claim 12, wherein the cooling head comprises at least two outlet nozzles oriented crosswise to the travelling direction (A) to emit a first and second air jet respectively.

14. A device as claimed in claim 13, wherein the two outlet nozzles are oriented in opposite directions, so that the first air jet is directed onto the lateral surface of the first packet , and the second air jet is directed onto the lateral surface of the second packet.

15. A device as claimed in claim 14, wherein the cooling head comprises at least one further outlet nozzle to emit a further air jet onto the heating member in substantially the opposite direction to the travelling direction (A).

16. A device as claimed in claim 1, and comprising transfer means for conveying the first and second packet, one above the other, from the work station along the respective first and second feed paths in a transfer direction (c) crosswise to the travelling direction.

17. Method of finishing packets having respective overwrappings of heat-shrink material, the method comprising a sealing step to seal the overwrappings, and a heat-shrink step to heat the overwrappings so that the overwrappings adapt to the configuration of the packets; the heat-shrink step being performed after the sealing step;

a feed step to feed at least a first and a second packet, each of which has a respective lateral surface, in a traveling direction along a first and a second feed path, respectively, to a work station where the first and second packet are brought together so that the lateral surfaces of the first and second packet are brought into contact with each other; the first and the second packet are brought together so as to be superimposed; when the first and second packet are brought together the lateral surface of the first packet faces downwards and the lateral surface of the second packet faces upwards;

at the heat-shrink step, a heating member heats at least the lateral surface of the first packet to shrink the overwrapping of the first packet; the heating member is interposed between the first and second feed path to shrink the overwrappings of the first and second packet heating the lateral surfaces of the first and second packet; and the method further comprising a cooling step, wherein a cooling unit cools the overwrappings; the cooling step being performed after the heat-shrink step and before the lateral surfaces of the first and second packet are brought into contact with each other; the lateral surface of the first packet, which lateral surface faces downwards as it is cooled by the cooling unit, and the lateral surface of the second packet, which lateral surface faces upwards as it is cooled by the cooling unit before the lateral surfaces of the first and second packet are brought into contact with each other.

18. Method as claimed in claim 17, wherein the first and second feed path are substantially parallel and substantially superimposed; the first and second packet being fed substantially parallel to each other along the first and second feed path, so that the lateral surfaces of the first and second packet are maintained parallel and facing each other; at the work station, the first and second packet being superimposed so that the lateral surfaces of the first and second packet are brought into contact with each other.

19. Method as claimed in claim 17, wherein, at the cooling step, at least one air jet is directed onto the lateral surface of the first and/or second packet.

20. Method as claimed in claim 17, wherein at least one air jet is directed onto the heating member .

21. Method as claimed in claim 17, wherein at least one air jet is directed crosswise to the travelling direction (A).

22. Method as claimed in claim 17, wherein at least one air jet is directed parallel to the travelling direction (A).

23. Method as claimed in claim 17, and comprising a transfer step to convey the first and second packet, one on top of the other, from the work station along the respective first and second feed paths in a transfer direction (c) crosswise to the travelling direction (A).

* * * * *